US010094630B1

(12) United States Patent
Loveday, IV et al.

(10) Patent No.: US 10,094,630 B1
(45) Date of Patent: Oct. 9, 2018

(54) AMMUNITION MAGAZINE WITH INTEGRATED COUPLER

(71) Applicant: Elite Tactical Systems Group, LLC, Cheyenne, WY (US)

(72) Inventors: George E. Loveday, IV, Knoxville, TN (US); George E. Loveday, III, Knoxville, TN (US)

(73) Assignee: Elite Tactical Systems Group, LLC, Cheyenne, WY (US)

( * ) Notice: Subject to any disclaimer, the term of this patent is extended or adjusted under 35 U.S.C. 154(b) by 0 days.

(21) Appl. No.: 14/527,767

(22) Filed: Oct. 29, 2014

Related U.S. Application Data

(60) Provisional application No. 61/962,018, filed on Oct. 29, 2013.

(51) Int. Cl.
*F41A 9/68* (2006.01)
*F41A 9/65* (2006.01)

(52) U.S. Cl.
CPC .. *F41A 9/65* (2013.01); *F41A 9/68* (2013.01)

(58) Field of Classification Search
CPC ..... F41A 9/61; F41A 9/68; F41A 9/65; F42B 12/207
USPC ..... 42/6, 49.01, 49.02, 50
See application file for complete search history.

(56) References Cited

U.S. PATENT DOCUMENTS 4,447,976 A * 5/1984 Cooper ..... F41A 9/63 42/18
4,484,403 A * 11/1984 Schwaller ..... B65D 21/0204 42/50
5,615,506 A * 4/1997 Jackson ..... F41A 9/63 42/50
6,668,479 B1 * 12/2003 Obong ..... F41A 9/63 206/3
7,073,285 B2 * 7/2006 Obong ..... F42B 39/02 224/931
8,322,065 B2 * 12/2012 Faifer ..... F42B 39/02 206/3
8,739,451 B2 * 6/2014 Nelson ..... F41A 9/65 220/23.4
2012/0311911 A1 * 12/2012 Nelson ..... F41A 9/63 42/90

* cited by examiner

*Primary Examiner* — John Cooper
(74) *Attorney, Agent, or Firm* — J. Kenneth Hoffmeister

(57) ABSTRACT

Aspects of a magazine for use with a repeating firearm are described. One unique aspect is that the magazine is fabricated completely from a translucent polymer that is highly resistant to mechanical, chemical, and thermal failures commonly affecting magazines. Another aspect of the magazine is the inclusion of a coupling system fully integrated into the housing that allows magazines to be securely joined together without the use of tools or additional components. A further aspect of the magazine is the easy release button design allowing the magazine to be disassembled by large or gloved fingers without need for a tool to depress the release button.

18 Claims, 10 Drawing Sheets

AMMUNITION MAGAZINE WITH INTEGRATED COUPLER

CROSS-REFERENCE TO RELATED APPLICATIONS

This application is claims the benefit of U.S. Provisional Application 61/962,018 filed Oct. 29, 2013.

BACKGROUND

Ammunition magazines have been coupled in various ways for many years. These methods include taping the magazines together and the use of external clamp style coupling devices. These methods can be difficult to assemble, bulky, unreliable, contain multiple components, and can be expensive. Many external coupling devices are limited to two magazines, and some couplers require tools, such as screwdrivers. It is with respect to these and other considerations that the present invention has been made.

BRIEF SUMMARY

Briefly described, this invention provides an improved ammunition magazine having an magazine coupling system without additional external components. The coupling system is bi-directional ambidextrous and can be engaged or disengaged in a very short time (e.g., one second).

The coupling system is self-aligning, requires no tools to engage or disengage, and is rotational in that the coupling system rotates around a center axis.

The coupling system features two stabilizers which limit movement of coupled magazines in multiple axes and has preload ramps built in.

The coupling system includes a lock which is a self-adjusting, rotational, ¼ turn locking mechanism having an alignment ring that interfaces with the semi-round collar with undercuts that capture the dual finger interface that extends from the center shaft.

The quick disassembly/re-assembly system has a floor plate, floor plate insert and a housing geometry that aid the user in disassembling and re-assembling the ammunition magazine during maintenance, without the use tools.

The floor plate features a bullet shaped slot that matches the bullet shaped tab on the floor insert. This slot also features an angled relief on three sides that allow the user to easily depress the floor insert with only a finger to remove the floor plate to disassemble the magazine.

The housing features internal ribs, similar to current polymer magazines; however, the internal ribs of this invention cease near the bottom of the housing. These ribs limit the depth of travel into the housing, thus correctly positioning the floor insert for assembly.

The magazine features a debris cover that greatly reduces the amount of dust, dirt, and other debris that can enter while the magazine is being stored.

The debris cover features an improved clip design consisting of two clips on either side of the back ridge. These clips are easily spread and disengaged when the thumb is moved vertically along the back ridge making the debris cover easily removable with one hand.

The housing features grip ribs on the lower half of the magazine that greatly enhances the users grip due to the sharp angled relief in the center of the rib. The sharp edges in these grip ribs are positioned in the center of the rib to prevent the edges from catching on magazine pouches and other types of storage devices.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

DETAILED DESCRIPTION

Aspects of a magazine for use with a repeating firearm are described herein and illustrated in the accompanying figures. One unique aspect is that the magazine is fabricated completely from a translucent polymer that is highly resistant to mechanical, chemical, and thermal failures commonly affecting magazines. Another aspect of the magazine is the inclusion of a coupling system fully integrated into the housing that allows magazines to be securely joined together without the use of tools or additional components. A further aspect of the magazine is the easy release button design allowing the magazine to be disassembled by large or gloved fingers without need for a tool to depress the release button.

Figure 1:
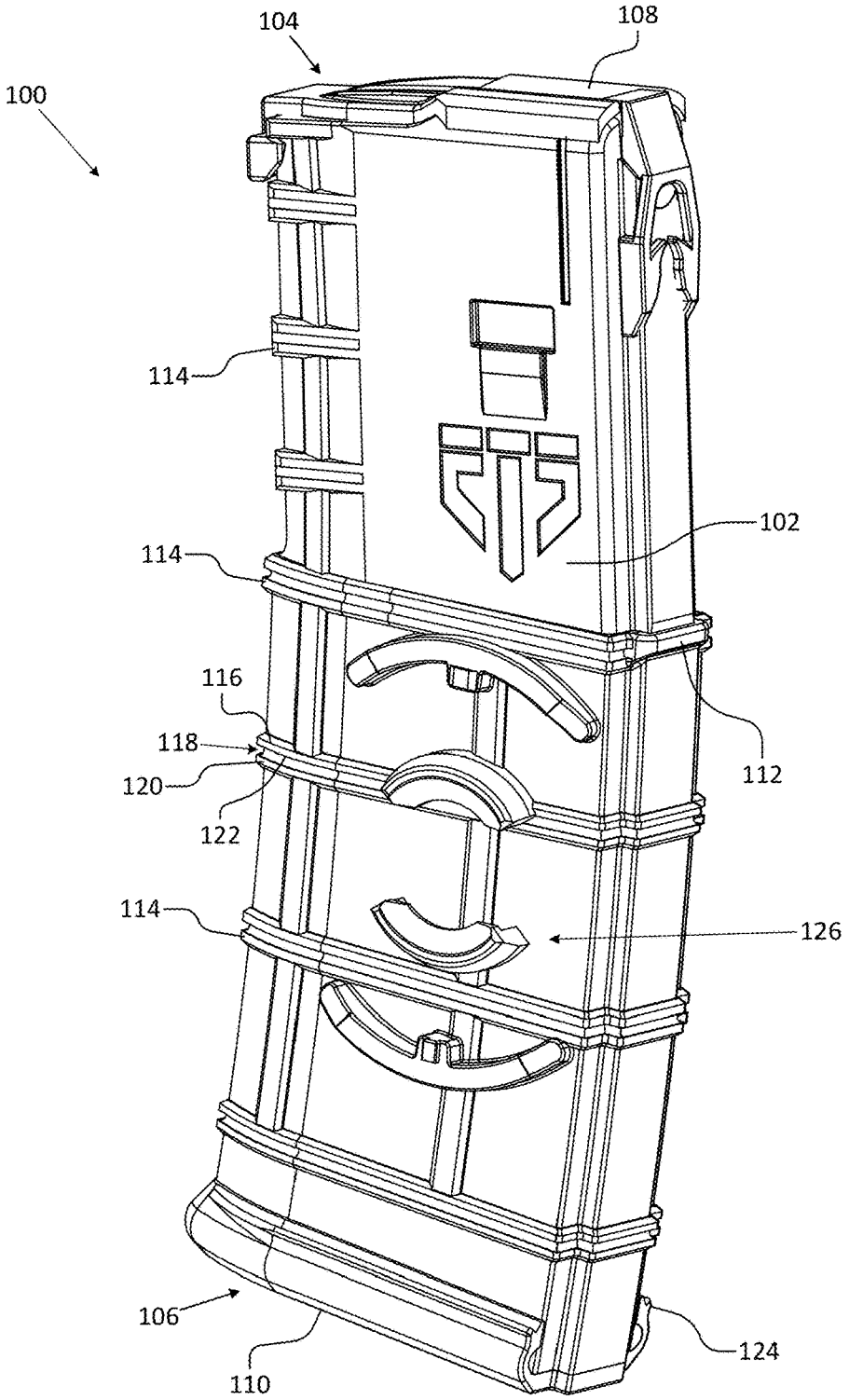
FIG. 1 is a perspective view illustrating aspects of the present invention embodied in a detachable box magazine for an automatic firearm.

FIG. 1 is a perspective view illustrating aspects of the present invention embodied in a detachable box magazine for an automatic firearm. The magazine 100 includes a housing 102 having a feed end 104 and a floor end 106. The magazine 100 is configured to hold ammunition used by the firearm. The upper portion of the housing 102 proximate to the feed end 104 is configured for insertion into the magazine well of the firearm. The feed end 104 interfaces with the firearm to guide ammunition cartridges into the firing chamber. In the illustrated embodiment, the feed end 104 is closed by an optional removable cover 108, and the floor end 106 is closed by a removable floor plate 110. Some embodiments include a limit tab 112 that prevents users from inserting the magazine 100 too far into the magazine well (i.e., over-insertion).

Aspects of the magazine 100 include a series of external ribs 114. The ribs 114 run substantially transverse to the direction of the force that is applied to insert the magazine 100 into or remove the magazine 100 from the magazine well of a firearm or a pocket, belt pouch, or other carrier. Typically, the ribs 114 are transverse to the long axis of the magazine 100 (i.e., substantially horizontal). The ribs 114 disrupt the generally smooth outer surface of the housing 102 and form raised features that reduces or eliminates slippage of the magazine 100 in a user's hand when then the user is gripping the magazine 100, especially when pushing or pulling on the magazine 100.

Depending upon location, each rib 114 may extend fully or partially across one or more faces of the housing 102. In the illustrated embodiment, for example, each rib 114 on the upper portion of the magazine 100 that fits into the magazine well is a small segment extending partially across the side face of the housing 102. However, the ribs 114 on the portion of the housing that is not inserted into the magazine well extended around the majority of the housing perimeter.

The outer edges 116 of the ribs 114 need not be sharp, angular corners. Instead, the outer edges 116 of the ribs 114 are slightly rounded or chamfered to minimize the likelihood that the ribs 114 will catch when the magazine 100 is being inserted into or removed from an object, such as and without limitation, a pocket or magazine pouch. To improve grip, each rib 114 features a central axial channel, or relief, 118. The top face 120 of the rib 114 on either side of the channel 118 is substantially flat. The upper edges 122 of the ribs 114 bounding the channel 118 define sharper, angular corners (i.e., not substantially rounded) that allow for superior grip on the magazine. When a pliable surface, such as a user's skin or glove, grips one of the ribs, the grip pressure is applied to the top faces and distributed over the rib 114 and the squeezes the skin or glove down into the channel 118 where the channel edges 122 catch the skin or glove, which results in greater friction at the interface. In the absence of gripping forces applied to the rib, the inner edges are protected. In the presence of the lateral forces encountered as the magazine 100 slides past another object with minimal downward pressure, the flat top faces of the ribs 114 guide objects over the channel so the inner edges do not catch on the object. Further, when being gripped, the rounded outer edges and flat top faces of the ribs 114 distribute the downward grip pressure and do not cut into a user's skin minimizing any discomfort a user might feel from the ribs 114 when pushing or pulling the magazine 100. An enlargement of some features of the ribs 114 appears in the inset of FIG. 4B.

Figure 2:
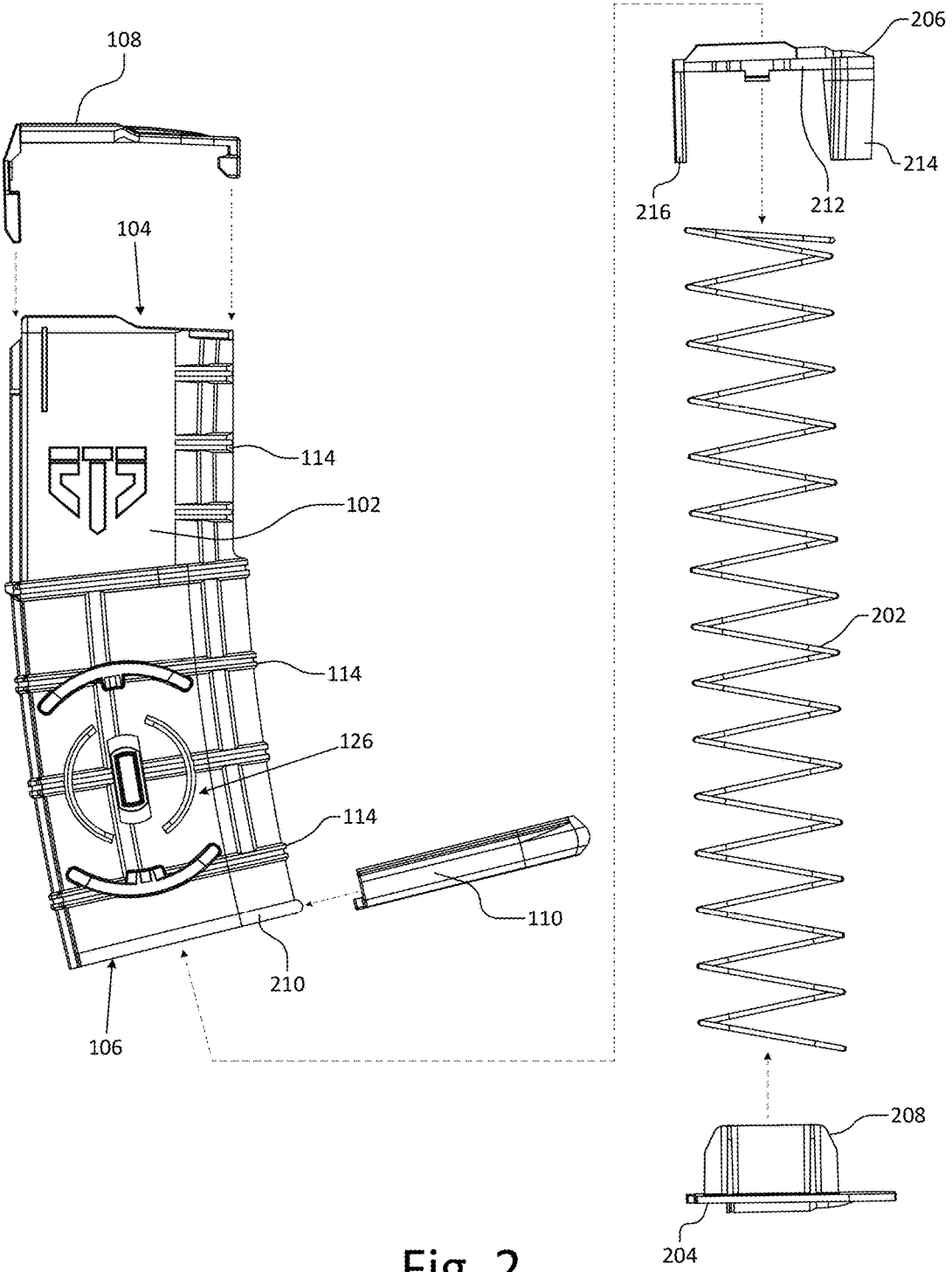
FIG. 2 is a exploded assembly drawing illustrating aspects of the magazine depicted in FIG. 1.

Because magazines 100 are typically stored upside down in magazine pouches and the only the floor plate 110 and, perhaps, a limited portion of the floor end 106 of the housing 102 are exposed, various embodiments of the floor plate 110 optionally feature a rib 124 that provides better grip when pulling on the floor plate 110 of the magazine 100. Additionally, a portion of an optional magazine coupling system 126 integrated into the housing 102 is visible in the illustrated embodiment FIG. 2 is an exploded view of the magazine for an automatic firearm depicted in FIG. 1. Internally, the magazine 100 includes a spring 202 with a floor insert 204 clipped to one end and a follower 206 clipped to the other end. The spring 202 is pushed over the floor insert spring guide 208 and is then attached to the spring clips of the floor insert 204. A floor plate 110 slides along a rail 210 that is proximate and substantially parallel to the bottom edge of the housing 102. When installed, the floor plate 110 is locked into place by the floor insert 204 under pressure from the spring 202.

In use, the spring 202 pushes the follower 206 upward through the housing 102 as ammunition is fed into the firearm. The follower 206 includes a shelf 212, a front leg 214, and, optionally, a rear leg 216. The shelf 212 is the platform that directly supports the ammunition cartridges. The front leg 214 operates as part of a follower stabilization system that reduces or eliminates axial tilt experienced by the follower 206.

The optional rear leg 216 serves as a spring guide. In some implementations, the capacity of the magazine 100 may be mechanically limited (i.e., pinned) to comply with legal restrictions. For example, a rivet may be installed through the rear side of the housing 102 to limit travel of the follower 206 and reduce usable portion of the magazine 100. When limited to small capacities (e.g., 10 rounds), the ammunition cartridges only occupy the upper portion of the magazine 100. Due to the tight clearances, the rivet cannot be installed in the portion of the magazine 100 that is inserted into the magazine well of the firearm. Accordingly, the rivet is generally installed in the lower portion of housing 102 (e.g., just below the limit tab 112). However, if the follower 206 were permitted to travel until the shelf 212 reaches the rivet, the magazine 102 would not comply with the capacity restriction. Instead, the rear leg 216 serves as a stop that extends below the follower 206 to engage the rivet while the shelf 212 remains at or above the minimum level to properly limit the capacity of the magazine 100.

Figure 3:
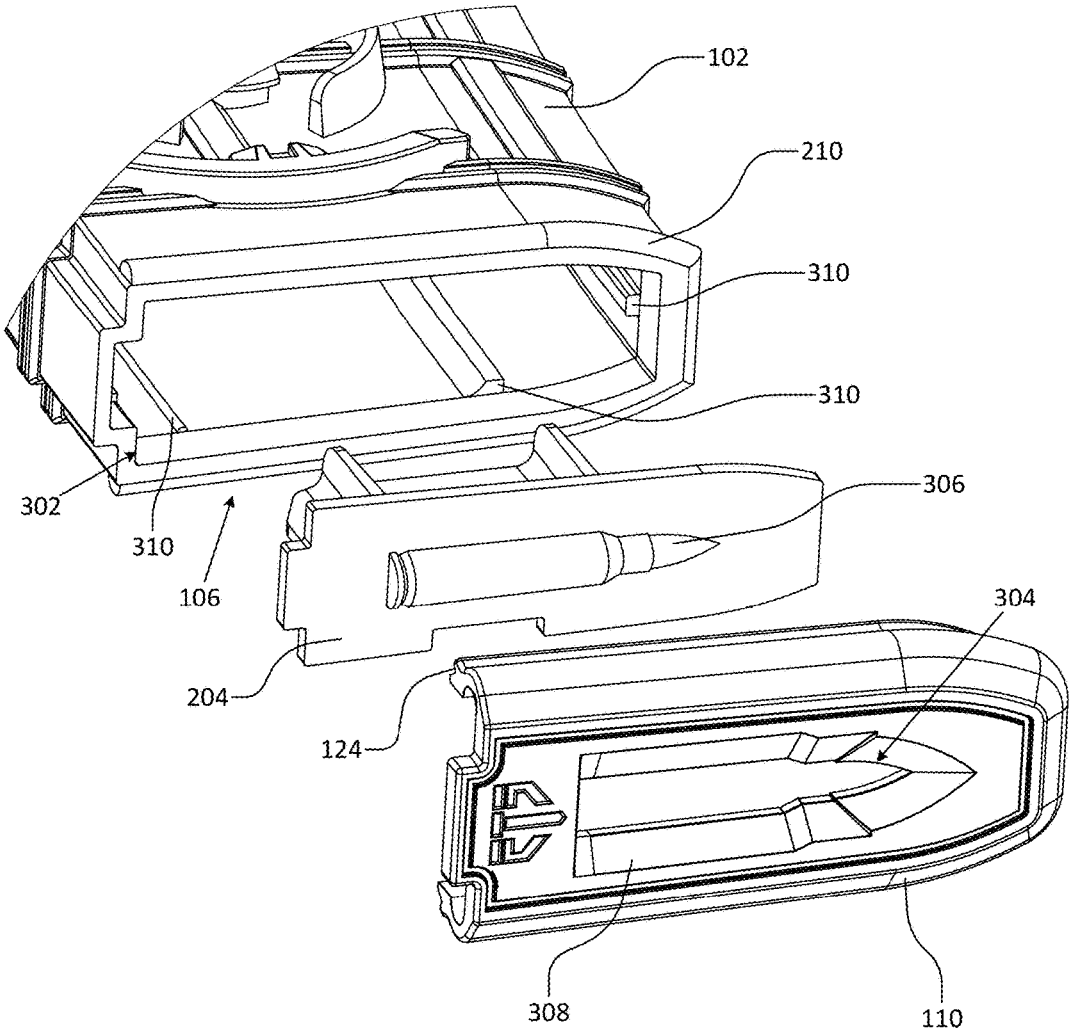
FIG. 3 is an exploded perspective view of the bottom portion of the magazine illustrating aspects of the floor plate release mechanism.

FIG. 3 is an exploded perspective view of the floor end assembly of the magazine depicted in FIG. 1. The installation and removal of the floor plate 106 allows the magazine 100 to be assembled and disassembled. Once installed, the floor plate 106 covers the floor end opening 302 defined by the housing 102 and provides the necessary support for the spring 202 to bias the follower 206 toward the feed end 104 of the housing 102. Removing the floor plate 106 allows the magazine 100 to be disassembled, for example, to maintain or clean the magazine 100.

The floor insert 204 include a tab 304 that is configured to be received by a corresponding slot 306 defined by the floor plate 106. In the illustrated embodiment, the tab 304 and the slot 306 are shaped like a bullet. The tab 304 is received in the slot 306 and held in place by compression applied by the spring 202. The interface between the tab 304 and the slot 306 prevents the floor plate 106 from sliding along the rail 210. The floor plate 106 remains securely attached to the housing 102 until the tab 304 is dislodged from the slot 304, for example, by pushing the tab 306 inward.

The dimensions of the slot 304 and tab 306 in conventional magazines are matched to provide a positive engagement that minimizes play. Further, conventional magazine floor plates are relatively thick, which further makes dislodging the tab 306 more difficult using one's fingers. For users that commonly wear gloves (e.g., hunters, law enforcement, or military personnel), disassembling a magazine can be problematic. However, gloves are not the only source of problems. Large fingers and certain conditions (e.g., arthritis) may also hinder the ability to push the tab 306. As a result, it is not uncommon for users to make use of tools (e.g., an ammunition cartridge, a screwdriver, or a rock) to free the tab 306 from the slot 304. At the very least, it is inconvenient for users to remove gloves or locate a tool just to disassemble a magazine.

In various embodiments, the external face of the floor plate 106 optionally defines a relief or depression 308 around at least a portion of the slot 304 to facilitate operative access to the tab 306. The illustrated embodiment shows an angled relief 308 made around three sides of the slot 304. The relief 308 allows the user to easily depress the tab 306 with a finger to disassemble the magazine 100, even while wearing gloves and without resorting to tools.

The interior of the housing 102 may include one or more internal ribs 310 that terminate before reaching the floor end 106 of the housing 102. The internal ribs 310 limit the depth that the floor insert 204 may travel into the housing 102. Limiting travel of the floor insert 204 facilitates re-assembly the magazine 100 by holding the floor insert 204 in the correct position.

FIGS. 4A-D are left side elevation, right side elevation, front elevation, and rear elevation views, respectively, illustrating aspects of the housing of the magazine depicted in FIG. 1. The feed end 104 defines a feed opening 402 and the feed lips 404 that captures the cartridges being pushed toward the feed opening 402 by the spring 202 and holds them in place.

Another aspect of the magazine 100 is the optional magazine coupling system. Structural details of one embodiment of the magazine coupling system are depicted in FIGS. 4A-D. FIGS. 5 through 7 illustrate additional aspects of the construction and operation of the embodiment of the magazine coupling system.

Aspects of the magazine 100 include a magazine coupling system 126 with a two part coupler that is completely integrated into the housing 102 and allows magazines 100 to be securely connected to other magazines 100. The magazine coupling system 126 is ambidextrous. The magazine coupling system 126 facilitates faster magazine changes when all of the cartridges have been fired. The magazine coupling system 126 is ambidextrous and can be engaged or disengaged very quickly using one hand (e.g., in less than one second).

The coupler includes a first fastener 406 integrated on one side (e.g., the left side) of the housing 102 and a second fastener 408 integrated on the opposite side (e.g., the right side) of the housing 102. The first fastener 406 and the second fastener 408 are configured to be selectively operatively engaged to securely couple two magazines 100 together and operatively disengaged to separate the two magazines 100. Magazines with the integrated coupler may be securely connected exclusively by manual manipulation (i.e., by hand). No additional components are or tools are needed couple the magazines 100 together.

In one implementation of the coupler, the first fastener 406 and the second fastener 408 are configured to rotate relative to one another about a central axis. The configurations of the first fastener 406 and the second fastener 408 define a mating position and a locked position for the second fastener 408 relative to the first fastener 406. The first fastener 406 and the second fastener 408 may be joined (i.e., mated) and separated (i.e., unmated) in when the mating position.

FIG. 5 illustrates an example of two magazines in a mated, but uncoupled state. In the illustrated embodiment, the first fastener 406 and the second fastener 408 are configured to be in the mating position when the two magazines 100 are oriented substantially orthogonal to one another. However, the first fastener 406 and the second fastener 408 may be configured such that the mating position occurs at another relative orientation of the two magazines. One the first fastener 406 and the second fastener 408 are mated, the magazines 100 are rotated into the locked position. Embodiments of the magazine coupling system feature bidirectional engagement allowing rotation in either direction to cause the magazines to be coupled.

Figure 6A:
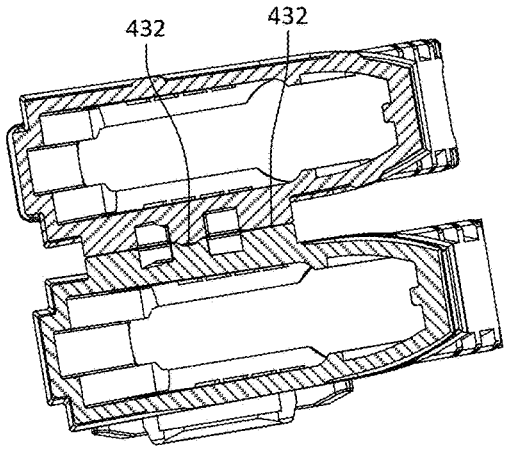
FIG. 6A is a sectional plan view taken along section A-A of FIG. 6 illustrating the interface between the first fastener and the second fastener.
Figure 6:
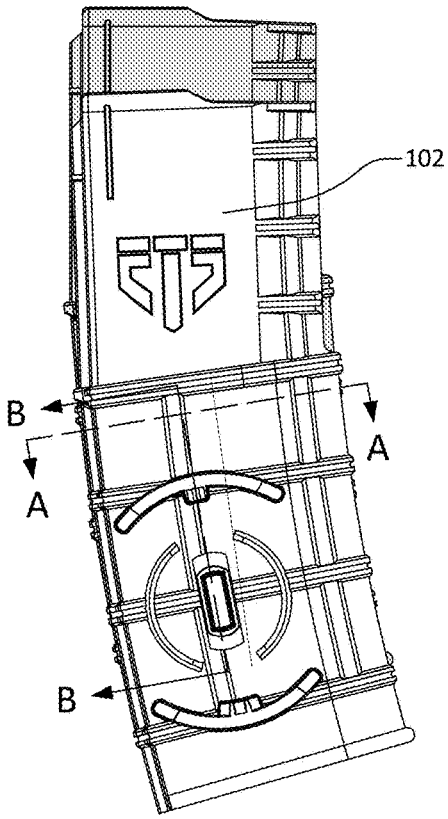
FIG. 6 illustrates two magazines coupled together using an embodiment of the coupler described herein.
Figure 6B:
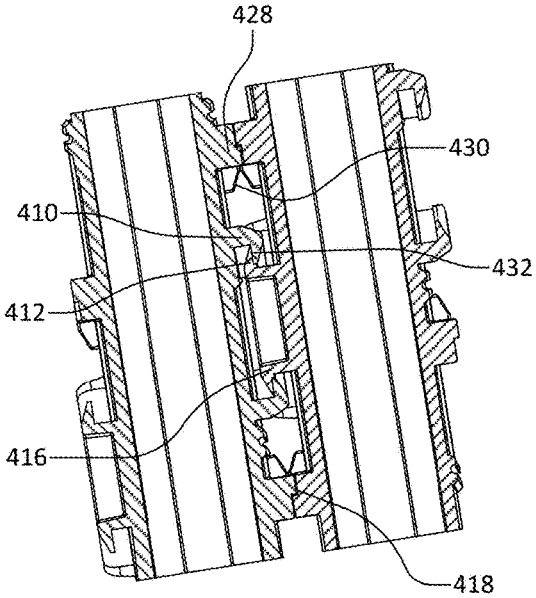
FIG. 6B is a sectional side elevation view taken along section B-B of FIG. 6 illustrating the interface between the first fastener and the second fastener.
Figure 7:
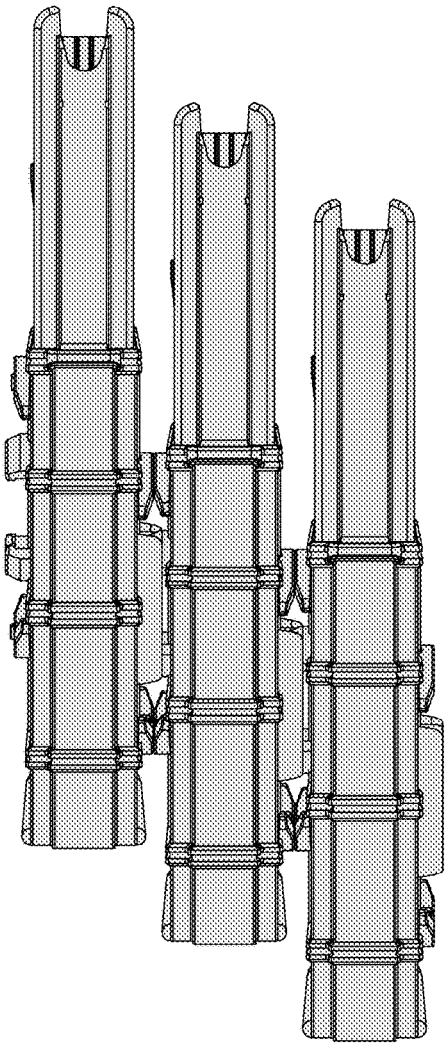
FIG. 7 is front elevation view of three connected housings joined using an embodiment of the coupler described herein.

FIGS. 6, 6A, and 6B illustrate aspects of the two magazines securely coupled together using an embodiment of the coupler described herein. FIG. 7 illustrates three magazines joined using an embodiment of the coupler described herein. The illustrated embodiment of the locking mechanism is configured such that the major axes of the two magazines 100 are substantially parallel to one another when in the locked position. However, the magazine coupling system may be configured to allow users to couple magazines in a variety of different orientations. For example, some embodiments allow the magazines to be vertically aligned with the feed ends pointing in the same direction or in opposite directions. Other embodiments may allow magazines to be coupled orthogonally or at other angles (i.e., 0° to 360°). For example, an orthogonal orientation may allow coupled magazines to be utilized in firearms where arrangement of the firearm near the magazine well prevents vertically coupled magazines from be used.

In the illustrated implementation of the magazine coupling system 126, the first fastener 406 and the second fastener 408 are configured as pairs of arcuate flanges 410, 412. Each flange 410, 412 is substantially parallel to the corresponding face of the magazine and is supported by a riser 414, 416 projecting outwardly from the face of the corresponding side of the housing 102. The flanges 410 of the first fastener 406 extend inwardly toward the focal points of the corresponding arcs. The flanges 412 of the second fastener 408 extend outwardly away from the focal points of the corresponding arcs. The first fastener flanges 410 and the second fastener flanges 412 are configured to overlap when operatively engaged. Stated differently, the second fastener 408 includes a center shaft with two fingers that extend outward 180° apart, and the first fastener 406 is configured with two semi-circular collars having under cuts that capture the dual finger interface of the second fastener 408.

Each of the first fastener and the second fastener also include a lock mechanism. The lock member generally includes a first lock part integrated on one side (e.g., the left side) of the magazine 100 and a second fastener 408 integrated on the opposite side (e.g., the right side) of the housing 102. The coupler includes one or more detents or other lock mechanisms 418 that resist rotation of the magazines 100 when engaged. In various embodiments, the lock mechanism 418 features a broad tooth interlock design. For example, one of the opposing fasteners 406, 408 defines a recess 422 and the other fastener 406, 408 defines a lock tab 420. When the magazines are positioned in the locked position, the lock tab 420 is received in the recess 422 to keep the magazines from rotating and becoming uncoupled. In various implementations only one of the support ribs includes a lock mechanism 418. Squeezing the ends of the magazines opposite from the support ribs where the lock mechanism 418 is located lifts the lock tab 420 out of the recess 422 and allows the magazines 100 to be readily rotated and separated. Various implementations of the lock design optionally include a built in self-adjusting wear interface 424 (see FIG. 6B) so the locks will remain tight even as they wear.

Geometrically, with respect to the first fastener 406, the distance from the central point $c_1$ between the pair of arcs to the riser 414 defines the outer radius $r_{o1}$. The distance from the central point $c_1$ between the pair of flanges 410 and the front edge of the flange 410 defines the inner radius $r_{i1}$. With respect to the second fastener 408, the distance from the central point $c_2$ between the pair of arcs to the front edge of the flange 412 defines the outer radius $r_{o2}$. The distance from the central point between the pair of arcs to the riser 416 defines the inner radius $r_{i2}$. The outer radius rot of the first fastener 406 is greater than the outer radius $r_{o2}$ of the second fastener 408. The inner radius $r_{i1}$ of the first fastener 406 is less than the outer radius $r_{o2}$ of the second fastener 408, but greater than the inner radius $r_{i2}$ of the second fastener 408.

The first fastener flanges 410 are separated from each other to create an area for receiving the second fastener 408. In the illustrated embodiment, the distance between the proximal ends of the separate first fastener flanges 410 defines the separation distance d. The second fastener flanges 412 have a width w that is defined by the secant connecting the ends of each second fastener flange 412. The width w of the second fastener flanges 412 is less than the separation distance d between the first fastener flanges 410.

The second fastener 408 optionally includes a guide 426 that facilitates proper alignment of the first fastener 406 with the second fastener 408 when mating. In some embodiments of the rotating coupler described herein, the guide is formed as a circular boundary wall or arcuate segments of the circular boundary wall having a radius greater than the outermost radius of the first fastener 406 (e.g., an outer semi-circular alignment ring).

Implementations of the coupler also include one or more support ribs associated with each of the first fastener 406 and the second fastener 408. In the illustrated embodiment, both the first fastener 406 and the second fastener 408 include a top support rib 428 and a bottom support rib 428. However, the number and relative positions of support ribs may vary. The support ribs provide multi-axial stabilization to minimize or eliminate coupled magazines from wobbling in the vertical and horizontal axes. Additionally, the support ribs also provide preload 432 (see FIG. 6B) to bring the first flanges of the first fastener 406 into frictional engagement with the second fastener 408 (i.e., to provide a tight fit for the fingers when interfacing with the collars). The ramps 430 at the ends of support ribs 428 reduce the initial rotational force and cycle stress on the coupler by slowly increasing the preload as the second fastener 408 is rotated relative to the first fastener 406 toward the locked position. In some implementations, the lock mechanisms 418 are integrated into the support ribs 428.

Figure 4A:
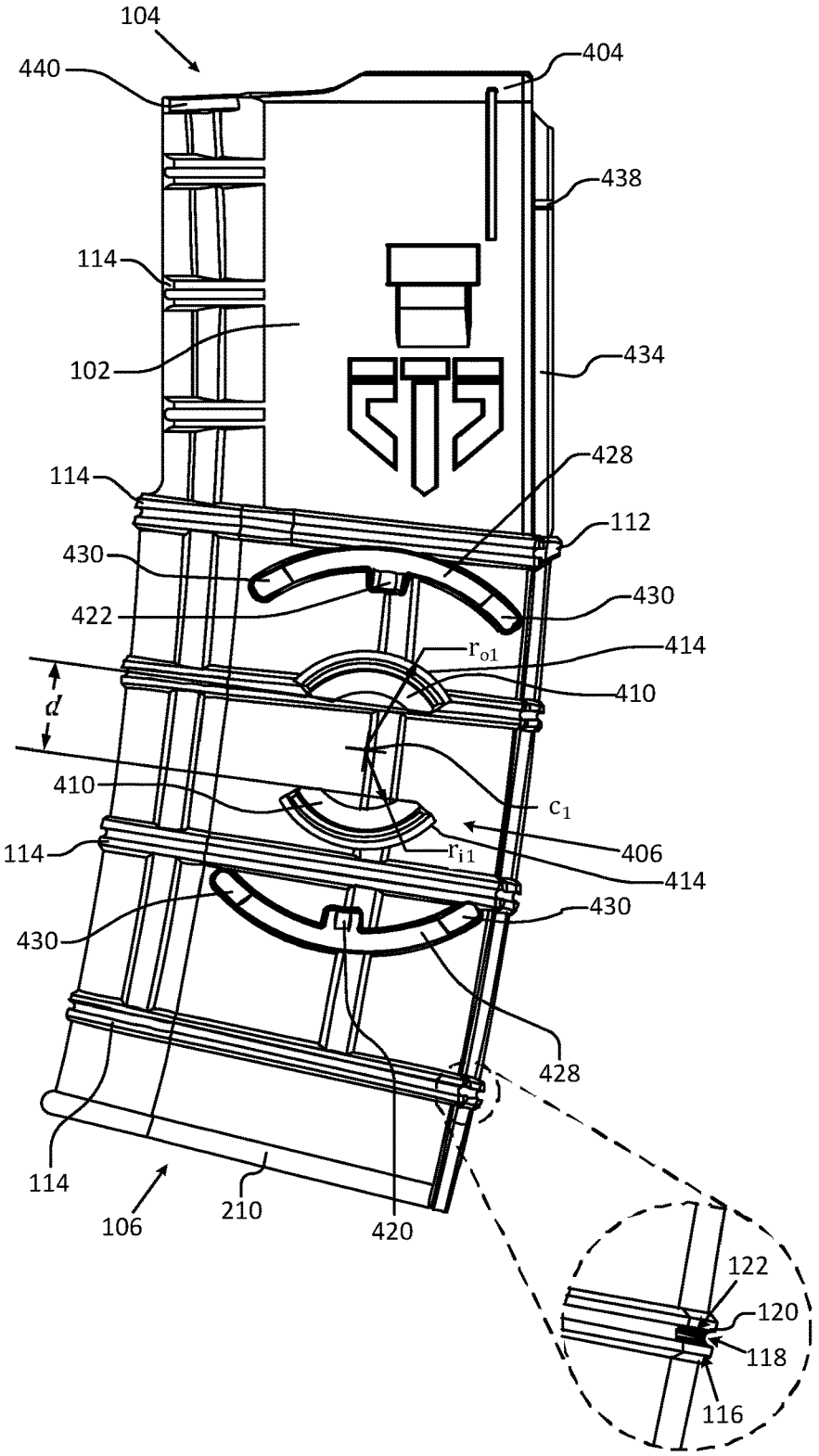
FIG. 4A is a left side elevation view illustrating aspects of the housing of the magazine depicted in FIG. 1.
Figure 4B:
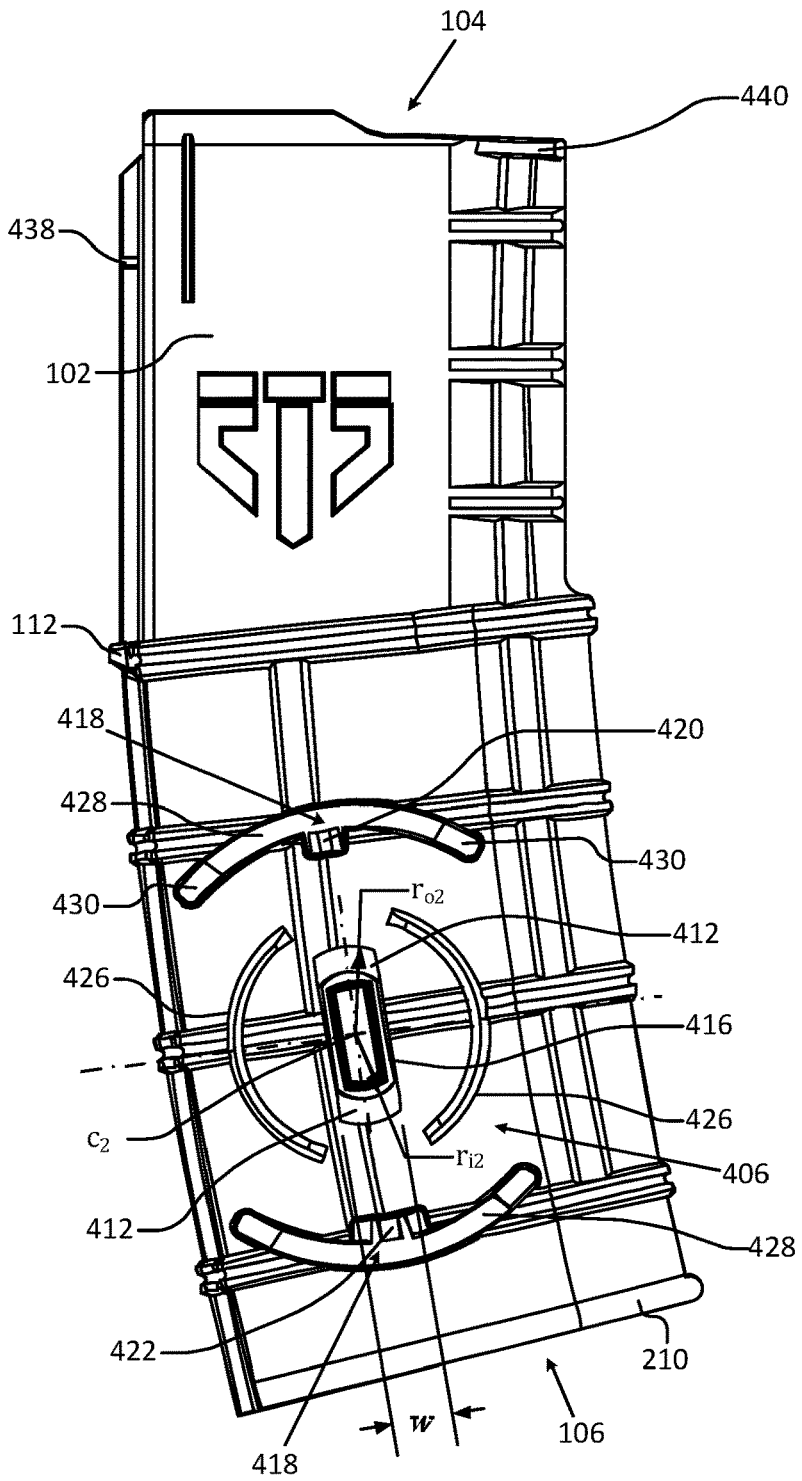
FIG. 4B is a right side elevation view illustrating aspects of the housing of the magazine depicted in FIG. 1.
Figure 4C:
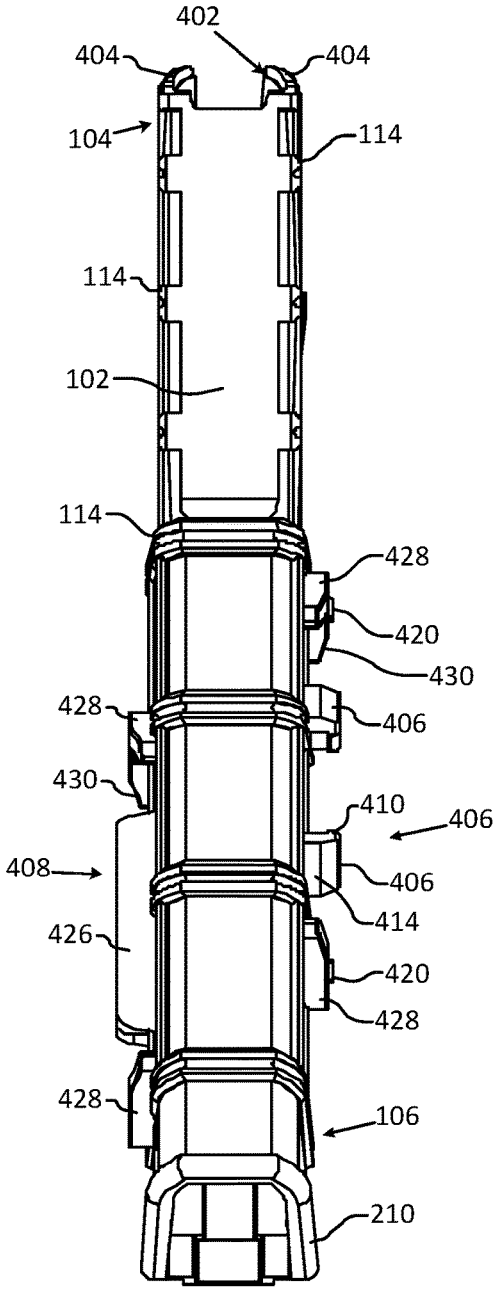
FIG. 4C is a front elevation view illustrating aspects of the housing of the magazine depicted in FIG. 1.
Figure 4D:
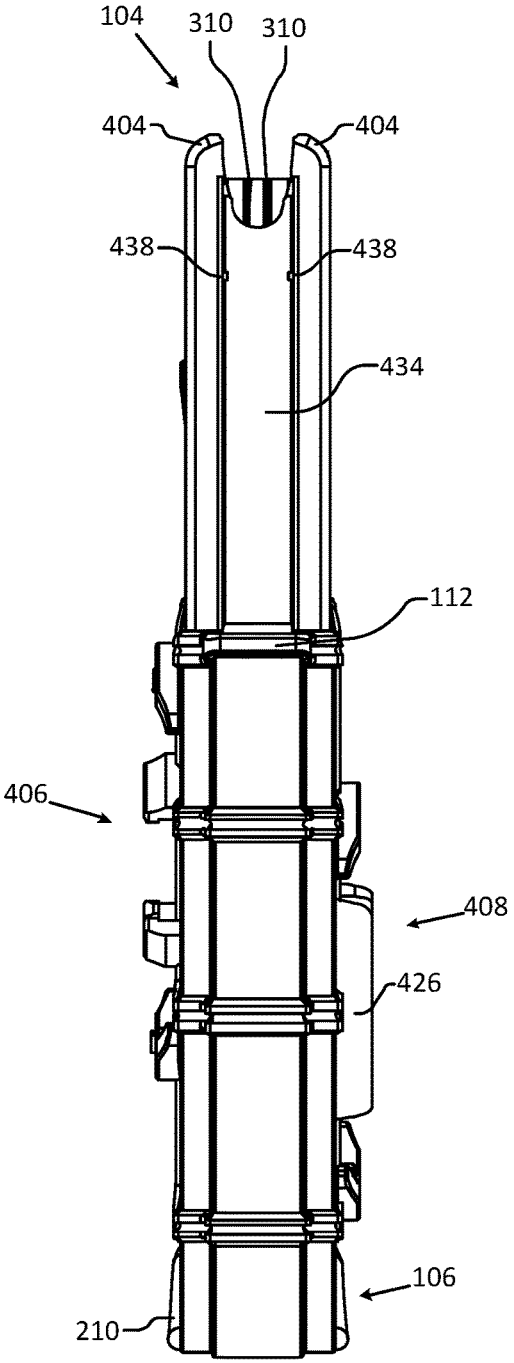
FIG. 4D is a rear elevation view illustrating aspects of the housing of the magazine depicted in FIG. 1.
Figure 4E:
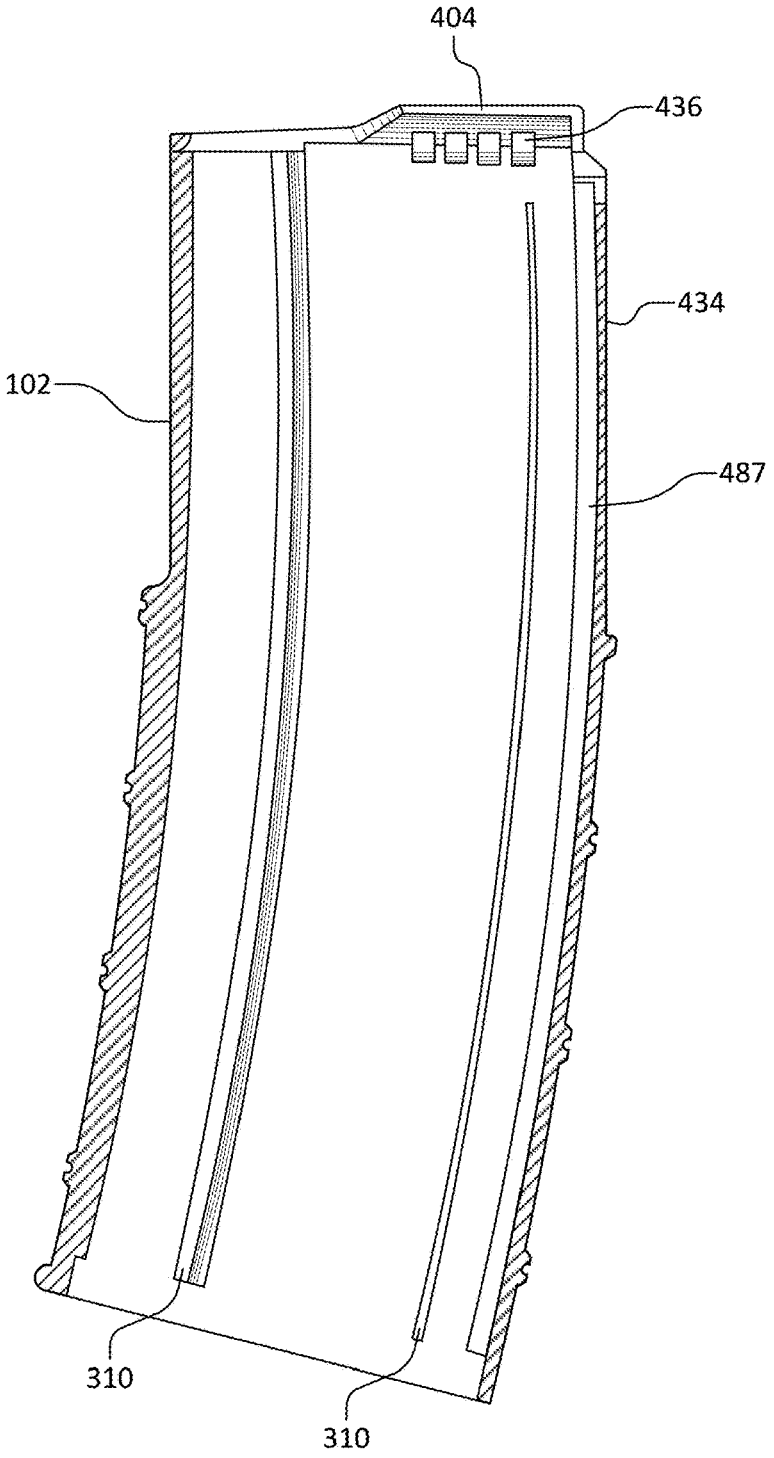
FIG. 4E is a sectional left side elevation view taken along section E-E of FIG. 4A illustrating the aspects of the housing interior.
Figure 5:
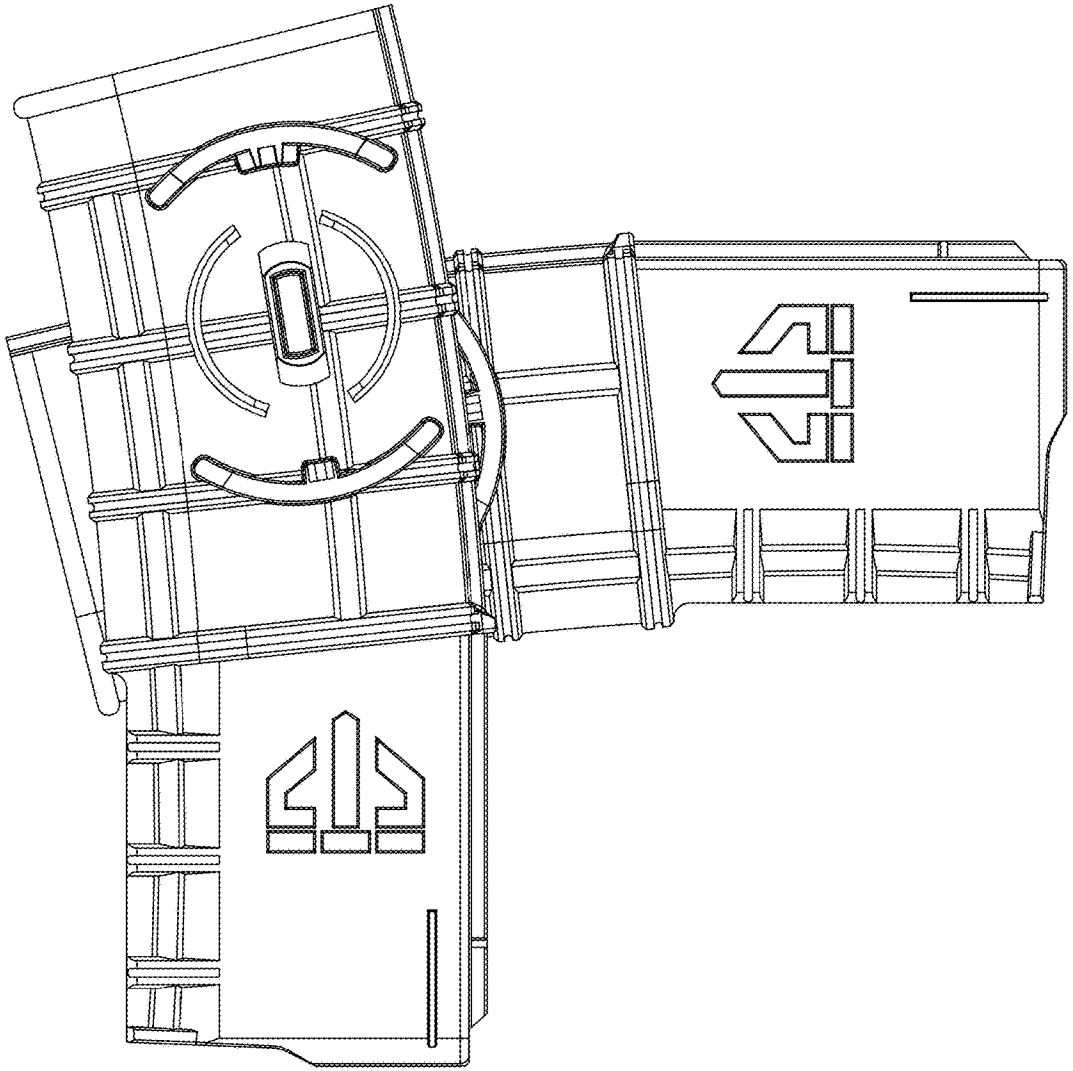
FIG. 5 illustrates an example of two magazines in a mated, but uncoupled state.

FIG. 4E is a sectional left side elevation view taken along section E-E of FIG. 4A illustrating the aspects of the housing interior. Embodiments of the housing 102 include one or more internal ribs 310 that smoothly guide the follower 206 as it moves through the housing 102. One side wall of the spine 434 that forms a bounded track 487 guiding the movement of the follower 206 is seen along the rear of the housing 102. The internal ribs 310 terminate before reaching the floor end 106 of the housing 102. As previously mentioned, the bottom edges of the internal ribs 310 define the upper limit of travel for the floor insert 204.

A series of optional internal projections 436 proximate to the feed lips 404 correspond to another aspect of the magazine 100 relating to the magazine coupling system. When magazines are coupled, each of the magazine is subjected to the forces (e.g., recoil) generated when firing the ammunition. Burst and fully-automatic weapon fire creates longer and sustained application of the forces, and the forces become more rhythmic. For the coupled magazine that is inserted into the magazine well, the cartridges are constrained by the firearm. However, the topmost cartridge in a coupled magazine residing outside of the firearm magazine well has a tendency to "walk" due to vibrations from firing the weapon and the compressive forces exerted by the spring. The end result is the topmost cartridge in the external coupled magazine moves forward and may protrude beyond the front edge of the magazine. A magazine with a protruding cartridge cannot be inserted into the magazine well. Accordingly, the protruding cartridge must be stripped off (i.e., manually ejected from the magazine) or properly reseated (i.e., pushed back into the magazine) before the magazine can be used. This wastes ammunition and/or eliminates the quick magazine changes associated with coupled magazines.

Adding small internal projections 436 on the interior of the housing 102 at the feed lips 404 slightly disrupts the generally smooth interior surface of the housing 102 enough to resist movement of the topmost cartridge in a coupled magazine 100 when the weapon is fired (i.e., adds friction) and hold the cartridge in place, but does not have an appreciable effect that interferes with actively feeding ammunition from the magazine 100 by the action of the firearm. Only a minimal amount of extension from the interior surface for the internal projections 436 to be effective. The amount of resistance to cartridge walking in coupled magazines may be varied by altering one or more factors including, but not limited to, the number, shape, position, and height of the internal projections. For example, the illustrated embodiment depicts four internal projections 436 with partially sloped or curved faces that make contact with the cartridge, but suitable can be obtained with more or fewer internal projections 436 and/or different face shapes (e.g., flat faces).

Figure 8:
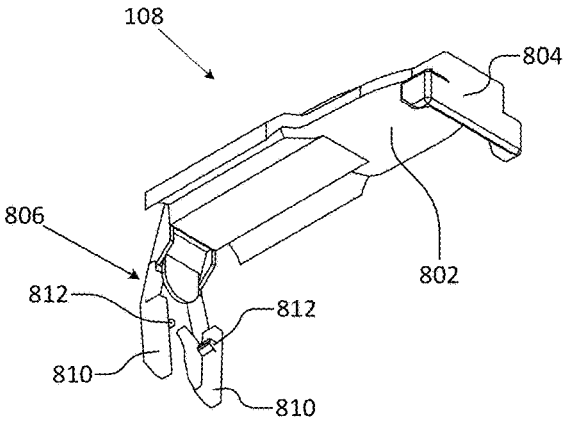
FIG. 8 is a perspective view illustrating aspects of the storage cover for the magazine depicted in FIG. 1.

FIG. 8 illustrates aspects of the storage cover for the embodiment of the magazine depicted in FIG. 1. The cover 108 minimizes or prevents dirt, dust and other forms of debris from entering the housing while the magazine 100 is being stored or transported. The cover 108 includes a lid 802 that covers the feed end opening 402. The front end of the cover 108 is securable to the magazine by a front arm 804 engages a projection 440 proximate to the top of the housing 100. The rear end of the cover 108 includes a clip 806 that engages the spine 434 on the rear side of the housing 100. In the illustrated embodiment, the clip 806 is a spring clip including two separate arms 810 that engage opposite sides of the spine 434. In various implementations, one or both arms 810 include a tab 812 configured to engage the corresponding slots 438 on the spine 434. The cover 108 is secured to the housing 102 when the front arm 804 engages the front projection 440 and the tab 812 of the clip 806 are positioned in engagement with the slots 438. The cover is removed from the housing 102 by spreading the free ends of the arms 810 (e.g., by sliding the user's thumb vertically up the spine between the arms) to disengage the tabs 812 from the slots 438. The ease with which the clip 806 disengages from the spine 434 is variable based on factors such as the mechanical properties of the material (e.g., elasticity), the arm configuration, the arm dimensions, and the number of tabs 812. For example, with a less pliable material, one tab

810 may be sufficient to secure the cover 108 to the housing 100, while two tabs 810 may be overly difficult to quickly dislodge using one hand.

The above specification, examples, and data provide a complete description of the manufacture and use of the composition of the invention. Since many implementations of the invention can be made without departing from the spirit and scope of the invention, the invention resides in the claims hereinafter appended.

What is claimed is:

1. A magazine for a firearm, the magazine comprising:

a housing having a front side, a back side, a left side, and a right side; and one and only one coupler comprising a first fastener and a second fastener, the first fastener formed on a first side, the first side being the left side or the right side, the second fastener formed on a second side, the second side being the opposite side from the first side, the first fastener configured to directly and operatively engage the second fastener of another substantially identical magazine to securely couple the magazines together by manual manipulation of the orientations of the magazines relative to each other, and a guide wall on the second side and positioned around at least a portion of the second fastener, the first fastener being aligned with second fastener when the first fastener of a second magazine is positioned within the guide wall of the first magazine.

2. The magazine of claim 1 wherein the first fastener and the second fastener comprise fingers that interlock to prevent separation of the coupled magazines.

3. The magazine of claim 1 further comprising a first support rib on the first side, and a second support rib on the second side, wherein when the fasteners of a pair of magazines are mated and the orientations of one magazine is changed relative to the other magazine, the second support rib pushes against the first support rib applying a preload to the fasteners.

4. The magazine of claim 3 wherein at least one of the first support rib and the second support rib further comprise a ramp to gradually increase the preload as the rotation of one magazine relative to the other magazine brings the first support rib and the second support rib into contact.

5. The magazine of claim 1 having a mating position and a lock position, the magazine further comprising a first lock component on the first side, and a second lock component on the second side, the first lock component configured to operatively engage the second lock component of another substantially identical magazine when the magazines are rotated into the lock position and, once operatively engaged, to cooperatively resist further relative rotation of the magazines until the first lock component and the second lock component are disengaged.

6. The magazine of claim 5 wherein the first lock component is a tab and the second lock component is a recess, the tab being disengaged from the recess by squeezing the ends of the coupled magazines together and rotating one magazine relative to the other magazine.

7. The magazine of claim 1 wherein the first fastener is vertically offset from the second fastener.

8. A magazine for a firearm, the magazine comprising:

a housing having a plurality of sides;

a first fastener formed on one side of the housing, the first fastener comprising a flange having at least two portions spaced apart by a separation distance; and a second fastener formed on the opposite side of the housing, the second fastener being complementary to the first fastener, the second fastener comprising a flange having at least two portions, the flange portions having a width less than the separation distance, the flange portions separated by a distance greater than the width, the first fastener flange configured to operatively engage the second fastener flange of another magazine to couple the magazines together upon manual manipulation of the relative orientations of the magazines.

9. The magazine of claim 8 further comprising a first support rib at least partially surrounding the first fastener and a second support rib at least partially surrounding the second fastener, wherein when the first fastener of one magazine is mated with the second fastener of another magazine and the orientations of one magazine is changed relative to the other magazine, the second support rib pushes against the first support rib applying a preload to the first and second fastener flanges.

10. The magazine of claim 9 wherein at least one of the first support rib and the second support rib further comprise a ramp to gradually increase the preload as the rotation of one magazine relative to the other magazine brings the first support rib and the second support rib into contact.

11. The magazine of claim 8 having a mating position and a lock position, the magazine further comprising a first lock component on one side of the housing, and a second lock component on the opposite side of the housing, the second lock component being complementary to the first lock component, the first lock component configured to operatively engage the second lock component of another magazine when the magazines are rotated into the lock position and, once operatively engaged, to cooperatively resist further relative rotation of the magazines until the first lock component and the second lock component are disengaged.

12. The magazine of claim 11 further comprising a first support rib at least partially surrounding the first fastener and a second support rib at least partially surrounding the second fastener, wherein the first lock component is a tab and the second lock component is a complementary recess, the first lock component and the second lock component being located above or below the first fastener and the second fastener, the first support rib and the second support rib forming a pivot point when the ends of the coupled magazines are squeezed together, the tab being disengaged from the complementary recess by squeezing together the ends of the coupled magazines distal to the first lock component and the second lock component and rotating one magazine relative to the other magazine.

13. The magazine of claim 8 further comprising a guide wall on the second side and positioned around at least a portion of the second fastener, the first fastener being aligned with second fastener when the first fastener of a second magazine is positioned within the guide wall of the first magazine.

14. A magazine for a firearm, the magazine comprising:

a housing having a plurality of sides;

no more than one first fastener formed on one side of the housing;

no more than one second fastener formed on the opposite side of the housing, the second fastener being complementary to the first fastener; and a guide wall on the second side and positioned around at least a portion of the second fastener, the first fastener being aligned with second fastener when the first fastener of a second magazine is positioned within the guide wall of the first magazine;

each of the first fastener and the second fastener configured to operatively engage and disengage the complementary fastener of another substantially identical magazine to couple and uncouple the magazines through manual manipulation of the relative orientations of the magazines bearing the complementary fasteners.

15. The magazine of claim 14 further comprising a first support rib at least partially surrounding the first fastener and a second support rib at least partially surrounding the second fastener, wherein when the first fastener of one magazine is mated with the second fastener of another substantially identical magazine and the orientations of one magazine is changed relative to the other magazine, the second support rib pushes against the first support rib applying a preload to the first and second fasteners.

16. The magazine of claim 15 wherein at least one of the first support rib and the second support rib further comprise a ramp to gradually increase the preload as the rotation of one magazine relative to the other magazine brings the first support rib and the second support rib into contact.

17. The magazine of claim 14 having a mating position and a lock position, the magazine further comprising a first lock component on one side of the housing, and a second lock component on the opposite side of the housing, the second lock component being complementary to the first lock component, the first lock component and the second lock component configured to operatively engage the complementary lock component of another magazine when the magazines are rotated into the lock position and, once operatively engaged, to cooperatively resist further relative rotation of the magazines until the first lock component and the second lock component are disengaged.

18. The magazine of claim 17 further comprising a first support rib at least partially surrounding the first fastener and a second support rib at least partially surrounding the second fastener, wherein the first lock component is a tab and the second lock component is a complementary recess, the first lock component and the second lock component being located above or below the first fastener and the second fastener, the first support rib and the second support rib forming a pivot point when the ends of the coupled magazines are squeezed together, the tab being disengaged from the complementary recess by squeezing together the ends of the coupled magazines distal to the first lock component and the second lock component and rotating one magazine relative to the other magazine.

* * * * *